United States Patent [19]

Landsberg

[11] Patent Number: 4,844,473

[45] Date of Patent: Jul. 4, 1989

[54] STRATEGY GAME

[76] Inventor: Marcus L. Landsberg, 7765 W. 91st St., Apt. F-3106, Playa del Rey, Calif. 90293

[21] Appl. No.: 174,769

[22] Filed: Mar. 29, 1988

[51] Int. Cl.[4] ..... A63F 3/02; A63F 3/00

[52] U.S. Cl. ..... 273/264; 273/282; 273/289

[58] Field of Search ..... 273/282 R, 282 C, 288, 273/247, 282 A, 282 B, 264, 289

[56] References Cited

U.S. PATENT DOCUMENTS

| | | | |
|---|---|---|---|
| 3,495,831 | 2/1970 | Healy | 273/282 R |
| 3,526,403 | 9/1970 | Clark | 273/247 |
| 3,693,976 | 9/1972 | Flack | 273/282 C |

*Primary Examiner*—Edward M. Coven

*Assistant Examiner*—Benjamin Layno

*Attorney, Agent, or Firm*—Price, Gess & Ubell

[57] ABSTRACT

A board game of strategy in which a plurality of unique game pieces are moved about a uniform array of descrete positions on a board. Each game piece has two game piece members linked by a specified length of chain. A linking member is attached to a swivel assembly located at or near the upper portion of each game piece to allow free rotation or one member about the other linking game piece member when the other linking game piece member is secured to a discrete position on the board. The relative distance of separation between the two linking members of a game piece can vary. However, the length of the chain automatically restricts the movements of the game piece on the game board.

18 Claims, 2 Drawing Sheets

FIG. 4
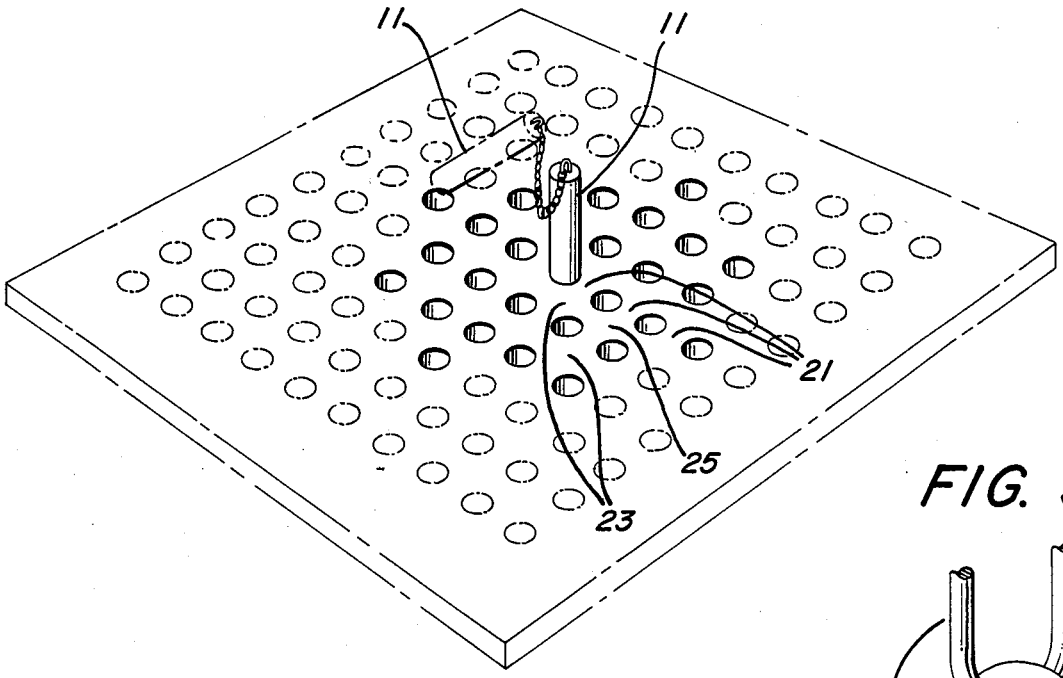
FIG. 5
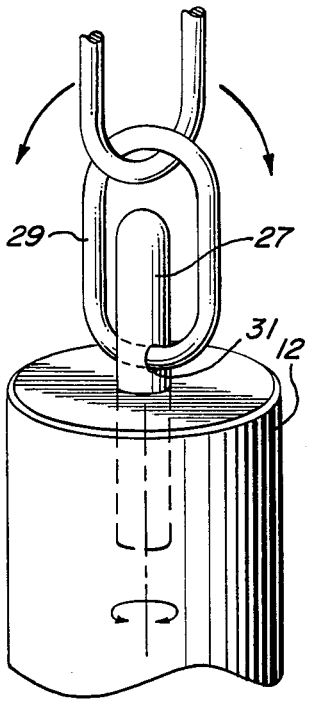
FIG. 6
| | | | | | | | | | |
|---|---|---|---|---|---|---|---|---|---|
| O | A | A | O | O | O | O | B | B | O |
| B | O | O | O | O | O | O | O | O | A |
| B | O | O | O | O | O | O | O | O | A |
| O | O | O | O | O | O | A | O | O | O |
| O | O | O | O | O | A | O | O | O | O |
| O | O | O | O | B | O | O | O | O | O |
| O | O | O | B | O | O | O | O | O | O |
| A | O | O | O | O | O | O | O | O | B |
| A | O | O | O | O | O | O | O | O | B |
| O | B | B | O | O | O | O | A | A | O |

STRATEGY GAME

BACKGROUND OF THE INVENTION

1. Field of the Invention

The present invention relates to a game of strategy, and more particularly, pertains to a board game and a method of playing the game, in which a plurality of unique game pieces are moved on a game board with an extremely large number of permutations available.

2. Description of the Prior Art

Games of strategy that are played upon a game board have been popular for ages. A few examples are chess, checkers and the Oriental game Go. The game boards used for such games of strategy designate an array of positions on which and between which the game pieces are moved. Such designations can either comprise a simple visual demarcation on the surface of the board such as a matrix of crossed lines, or contrasting squares such as on a typical checkerboard. Alternatively, the allowable positions can be designated by a pattern of holes or some other three-dimensional configuration. Two sets of game pieces, one for each player, are normally moved about on the game board, the two sets being somehow distinguishable from one another either by color or shape. Each set may actually be made up of a number of different pieces such as in chess, or the whole set may comprise a plurality of identical pieces such as used in checkers or Go. Typically, such game pieces are simple objects such as chips or stones but may be more embellished as in the case of the various chessmen. Invariably, in such games of strategy, two players match wits in moving two sets of game pieces about the game board in accordance with the game rules until ultimately one or the other prevails. The rules range from the extremely simple, such as a single type of move for all pieces, to the considerably more complex, wherein a hierarchy of pieces is each limited to a unique type of move under a given set of circumstances. It is especially advantageous for such a game to be exceedingly simple in terms of equipment and rules to encourage beginner players, while providing an extreme number of positional variations and permutations to satisfy sophisticated players.

Since games have existed for at least the time period of recorded history, there is always a need for a new and challenging game, even in this crowded field.

SUMMARY OF THE INVENTION

It is therefore an object of this invention to provide a highly challenging game of strategy with the use of very simple game pieces and a simple game board.

It is a further object of the present invention that a large number of positional variations and permutations are possible.

It is another object of this invention to provide a method of playing the game.

According to the present invention, the foregoing and other objects are attained by a game of strategy of the present invention in which a plurality of unique game pieces are moved about a game board in accordance with a prescribed set of rules. Each game piece comprises two identical game piece members linked by a flexible connector, such as a chain. The specific design configuration of the game pieces restricts their movements on the game board to an array of discrete positions. The players take turns moving only one game piece member of their set of game pieces at a time.

Causing the chain of one's game piece to cross the chain of an opponent's game piece constitutes a "capture" that severely limits the future moves that are then available to that particular game piece. The first player who succeeds in either "capturing" all of the opponent's game pieces in this manner, or, alternatively, aligning at least five of his own game piece members in a row, wins.

BRIEF DESCRIPTION OF THE DRAWINGS

Further objects and advantages of the invention will hereinafter become more fully apparent from the following description of the annexed drawings which illustrate the preferred embodiments and wherein:

FIG. 4 shows the positional variation of an individual game piece;

FIG. 5 is a perspective view of an alternate coupling design; and

FIG. 6 is a schematic representation of a starting position.

DETAILED DESCRIPTION OF THE PREFERRED EMBODIMENT

The following description is provided to enable any person skilled in the strategy game field to make and use the present invention and sets forth the best modes contemplated by the inventor of carrying out his invention. Various modifications however, will remain readily apparent to those skilled in the art, since the generic principles of the present invention have been defined herein specifically to provide an improved strategy game and method of playing game.

Figure 1:
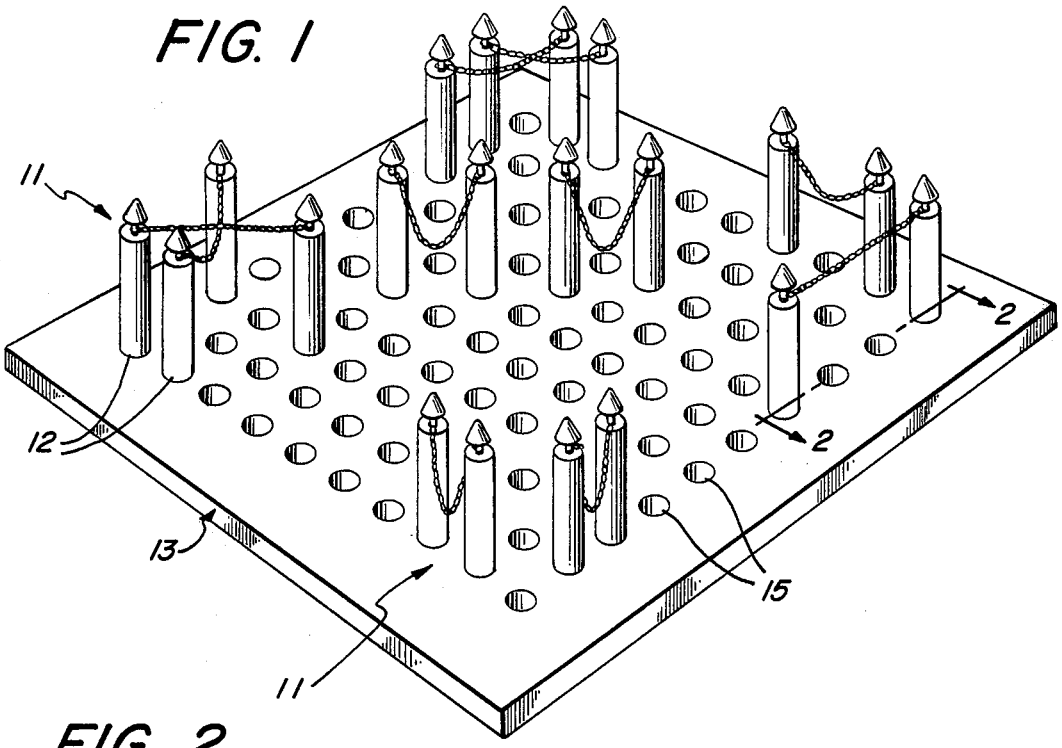
FIG. 1 is a perspective view showing the game pieces arranged on the game board.

FIG. 1 illustrates the preferred embodiment of the invention and shows a plurality of game pieces, designated 11, positioned on a game board 13. The game board 13 has an array of discrete positions demarked thereon and can be formed of wood, plastic, cardboard, etc. In a preferred embodiment, a $10 \times 10$ array of 100 holes 15 is arranged on the top surface of the board 13. These holes 15 are capable of receiving and supporting the game pieces 11. Any design or configuration of holes that positively locates the game pieces may by used. Designs are not limited to round holes or even holes at all. For instance, an array of pegs on which game pieces can be seated or even a set of game pieces with stable weighted bottom portions provides an equally viable alternative. The prime requirement is to ensure a stable positioning of the game pieces 11 that will provide a clear limitation of relative movement of the game piece members 12. The game board may be marked to identify the individual positions. The positions can be, for example, numbered from 1 to 100 or, alternatively, an alphanumeric Cartesian coordinate system can be used wherein a numerical designation of rows and an alphabetic designation of columns serves to positively identify each and every position. Such an identification system would enable players to compete by mail and would facilitate the presentation of problems and puzzles as well as the instruction of strategy and tactics. Moreover, it would further lay the groundwork for a computerized version of the game in which the players' moves can be keyed into a terminal and responses simply displayed as an alphanumeric message. In addition, the starting positions, as described below, can be designated on the board itself. If such an aid would only be beneficial while first gaining familiarity with the game, a temporary demarcation such as a removable overlay would adequately fulfill this function.

Each game piece 11 includes two identical members 12. The base of each member, which may have a portion or section of a reduced diameter 17 of a complementary configuration to the holes, can be inserted in the holes 15 on the game board 13. The lip 18 serves to support the game piece. Alternatively, a game board may be used having an array of holes of a depth somewhat less than the thickness of the board. In such a design, the game piece 11 may be supported by the bottom surface of the hole, obviating the need for a lip 18. Again, it is desirable to ensure a relatively constant vertical position for each game piece member 12.

Figure 2:
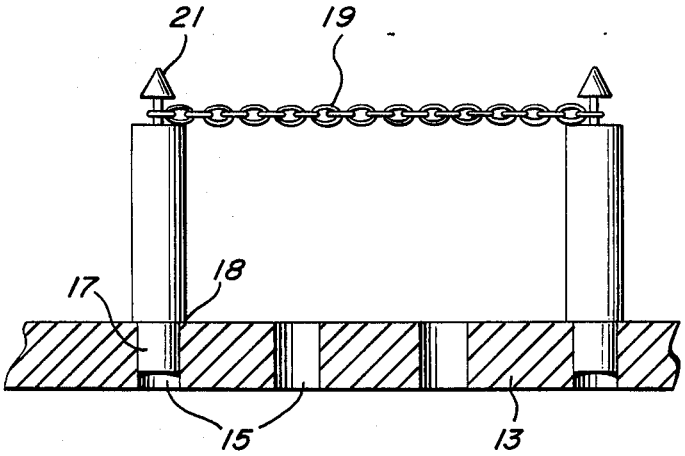
FIG. 2 shows a partial cross-sectional side view of an individual game piece and the game board.

The two game piece members 12 are preferably identical elongated solid cylinders and are linked by a linking member such as a chain 19 which allows up to and including a specified maximum separation. Preferably, the height of the elongated cylinders is such that the length of chain 19 dangling between them does not contact the game board when the two game piece members are placed in adjacent positions on the game board. A further requirement is that each game piece member be substantially rigid and inflexible so that the maximum separation is strictly dictated by the chain or linking member length and is not affected by any amount of distortion of the game piece member itself. The chain is attached to each game piece member via a coupling 21 that allows free rotation of the chain about the game piece member. The attachment of the linking member or the flexibility of the linking member must be such to allow free movement of one game piece member up and around opposing game piece obstacles on the game board while the game piece member to which it is linked remains in place on the game board. This requires a full three-dimensional freedom of movement. A suitable coupling 21 is illustrated in FIG. 2. The chain is free to rotate about the game piece member in a plane parallel to the game board, and the flexibility of the chain allows one game piece member to be elevated above the other as is necessary when moving about the game board. In an alternative embodiment, the chain is attached to a clasp or circlip rotatably disposed in a groove near the top of a game piece member. The swivel post illustrated in FIG. 5 imparts a three-dimensional range of movement to the coupling itself. The post 27 is rotatably mounted in the top of the game piece member 12 and the first link 29 extends through a hole 31 in the post so that it is free to swivel in a plane perpendicular to the plane of the game board. The hole 31 is located such that the length of the first link 29 is sufficient to enable it to clear the top of the post 27, as shown in FIG. 5.

The length of chain 19 is specifically selected such that the game piece member 12 can be inserted in holes 15 on game board 13 with a maximum separation of three positions on the board. While the chain limits maximum separation, it does allow placement in closer positions wherein a first game piece can be separated from the second game piece by one, two or three linear displacements 21, two diagonal displacements 23 or one semidiagonal displacement 25 as illustrated in FIG. 4. This allows 28 different placements of a second member for a given position of a first member. The linking member need not necessarily be constructed of a length of a chain. It is, however, imperative that the linking member positively limits the maximum separation of the two game piece members. A string or a cord would be a viable alternative as would, for example, an elastic, elongatable bungee cord that has a provision for limiting its maximum elongation.

The game board may be constructed of wood. A flat surface with a uniform array of uniformly sized holes is required. Alternatively, a plastic material can be used. Preferably, the game pieces are fashioned from wood or molded from plastic, although other materials can be used, as known, for example, in chess games. The link may be preferably made from any material that is flexible but not stretchable beyond a certain point. A length of chain conforms to such a specification.

Figure 3:
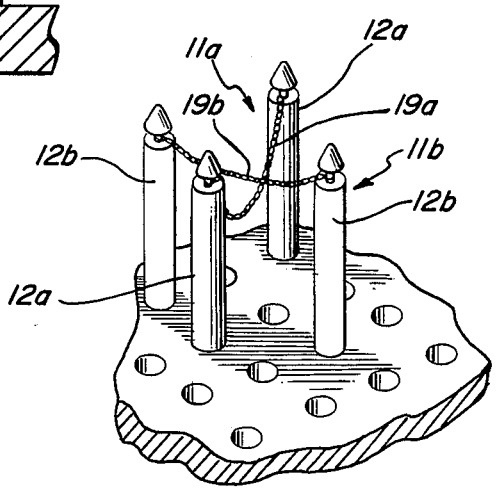
FIG. 3 is a perspective view of a captured game piece.

The game is played by placing a plurality of game pieces in a starting configuration upon the game board. Preferably two players are each assigned five game pieces each. Each set of game pieces is distinguishable from the other set of game pieces by either color, finish or some other form of demarcation. Both the game piece members as well as the linking members must be distinguishable from those of the opponent. A preferred starting configuration is schematically represented in FIG. 6. The "0's" designate vacant positions while the "A's" indicate the positions of a first player's game pieces and the "B'" indicate the positions of the opponent's game pieces. The players take turns moving one game piece member of a game piece at a time. Their move options are limited by the physical restriction of the chain 19. An opposing player's game pieces can be "captured" by arranging one's game piece such that the chain crosses over the opponent's chain as illustrated in FIG. 3. In this illustration, since chain **19*b* passes over chain 19*a*, game piece 11*b* has "captured" game piece 11*a***. It is in a crossed position wherein the necessity of being able to distinguish one player's chain from that of the other becomes apparent, such as discerning which chain actually crosses over the other. The opponent's movements are subsequently limited to those wherein the chains are not uncrossed. In other words, a game piece member of a captured game piece can only be relocated to those positions which do not require that the game piece member be passed under the opponent's chain. In addition, recrossing over the captor's chain is not allowed. A further limitation is imposed on the captured game piece in that it cannot be moved to a position which requires its chain to follow a circuitous path about an opponent's game piece. Although the minor chain deflection is allowed when a capturer's game piece lies directly between two game piece members of the captured game piece, a deflection beyond that is not allowed. The game proceeds until either all of one player's game pieces are "captured" or, alternatively, one player succeeds in positioning five of his own game piece members in a straight line.

Obviously, many modifications and variations of the present invention are possible. In light of the above teachings, it is therefore to be understood that within the scope of the appended claims, the invention may be practiced otherwise than as specifically described.

What is claimed Is:

1. A game piece for use in playing a board game comprising:

a first member having a top and bottom portion;

a second member having a top and bottom portion;

a swivel assembly located at or near the top portion of the first member and second member, respectively, and a linking member, rotatably linked to the swivel assembly of each member for allowing rotation and variable separation of one member with respect to the other up to a predetermined maximum separation.

2. The game of claim 1 wherein the first member comprises an elongated cylinder, the second member is identical to the first member, and the linking member comprises a length of chain, each end rotatably attached to the swivel assembly located at or near the top of each member.

3. A plurality of game pieces for use in conjunction with a game board which designates discrete positions, each game piece comprising;

a first member having a top and bottom portion;

a second member having a top and bottom portion, the first and second members positionable on the game board designating discrete positions;

a swivel assembly located at or near the top portion of the first member and second member, respectively, and a linking member, rotatably linked to the swivel assembly of each member for allowing rotation and variable separation of one member with respect to the other up to a maximum separation of a predetermined number of discrete positions as designated on the game board.

4. The game piece of claim 3 wherein the first member is identical to the second member and the linking member comprises a length of chain attached to the swivel assembly of each game piece member so as to allow free rotation about said member.

5. The game piece of claim 3 wherein the first and second member are positionable on a game board designating a 10×10 uniform array of 100 discrete positions and the linking member allows a maximum separation of three discrete positions.

6. A game apparatus for playing a game of strategy comprising:

a game board defining discrete positions, and two sets of game pieces each game piece having two identical game piece members linked by a linking member attached to a swivel member located at or near the top of each game piece member so as to allow free rotation of one member about another member when that member is placed in a discrete position on the board.

7. The game apparatus of claim 6 wherein the game board comprises a flat surface designating a 10×10 uniform array of 100 discrete positions.

8. The game apparatus of claim 7 wherein each discrete position comprises a receiving configuration capable of receiving a game piece member.

9. The game apparatus of claim 6 wherein each set of game pieces comprises five game pieces.

10. The game apparatus of claim 6 wherein one set of game pieces is readily distinguishable from the other set of game pieces by a difference in color.

11. A method of playing a game of strategy by two opponents employing a game board designating an array of discrete positions and two sets of game pieces, each game piece having two game piece members linked by a flexible linking member which limits the maximum separation of the two game piece members, comprising the steps of:

arranging the game pieces in a starting pattern;

each opponent taking turns to move one game piece member from one position to another unoccupied position on the game board, said movement being limited by the linking member;

capturing an opponent's game piece by moving a game piece member to a position such that the linking member crosses over an opponent's linking member thereby limiting the opponent's movements of that game piece to ones that do not cross the linking members, and continuing such movements until one opponent prevails by either capturing all the opponent's game pieces or arranging a predetermining number of game pieces in a row.

12. In a strategy game including a game board having an array of definitive positions and two sets of multiple game pieces, the improvement comprising:

a plurality of first and second game piece members having a substantially greater height than width and each having a top and a bottom portion;

swivel means located at or near upper portion or the first and second game piece members, respectively;

means for pivotally connecting pairs of first and second game piece members via the swivel members located at or near their upper portions, and means for vertically aligning the game piece members in substantially parallel arrangements perpendicular to a plane containing the surface of the game board, the bottom portion of each game piece member removably coacting with the aligning means.

13. The strategy game of claim 12 wherein the connecting means comprises a flexible member, the length of the flexible member being slightly greater than the respective first and second game piece members.

14. A strategy game including a game board having a uniform array of position, the array of game board positions defining a plurality of intersecting columns and rows, and two sets of multiple game pieces, the improvement comprising:

a plurality of pairs of longitudinal game piece members, each game piece member adapted for removably coacting with the game board positions, and means for pivotally connecting pairs of first and second longitudinal game piece members at or near the top of each game piece member and for limiting the maximum displacement of the first game piece member with respect to the second game piece member to multiples of the linear distance between two adjacent positions in the same column or row.

15. In a strategy game comprising a plurality of game pieces and a game board which designates a uniform array of discrete positions, each game piece comprising:

a first member:

a flexible linking member, and a second member, linked to the first member by a linking member, said first and second members positionable on a game board designating discrete positions, said linking member allowing up to a maximum separation of a predetermined number of discrete horizontal or vertical positions as designated on the game board.

16. The game piece of claim 15 wherein the first member is identical to the second member and the linking member comprises a length of chain attached to each game piece member so as to allow free rotation about said member.

17. The game piece of claim 16 wherein the first and second members are positionable on a game board designating a 10×10 uniform array of 100 discrete positions.

18. In a strategy game including a game board having a 10×10 uniform array of definitive positions and two sets of multiple game pieces, the improvement comprising:

a plurality of first and second game piece members having a substantially greater height than width and each having a top and a bottom portion;

means for connecting pairs of first and second game piece members via their upper portions and for limiting the maximum displacement of the first game piece member with respect to the second game piece member to multiples of horizontal or vertical positions as defined by the array of positions, and means for vertically aligning the game piece members in substantially parallel arrangements perpendicular to a plane containing the surface of the game board, the bottom portion of each game piece member removably coacting with the aligning means.

* * * * *